US006482035B2

(12) United States Patent
Okabe et al.

(10) Patent No.: US 6,482,035 B2
(45) Date of Patent: Nov. 19, 2002

(54) PRESS-CONNECTING CONNECTOR

(75) Inventors: Toshiaki Okabe, Shizuoka (JP); Tetsuya Yamashita, Shizuoka (JP); Toshiaki Ozawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/892,509

(22) Filed: Jun. 28, 2001

(65) Prior Publication Data

US 2002/0002002 A1 Jan. 3, 2002

(30) Foreign Application Priority Data

Jun. 30, 2000 (JP) ..... 2000-199026

(51) Int. Cl.[7] ..... H01R 13/40
(52) U.S. Cl. ..... 439/596; 439/752
(58) Field of Search ..... 439/596, 752, 439/595, 744, 746, 745, 748, 749, 686, 889, 695, 696

(56) References Cited

U.S. PATENT DOCUMENTS 5,295,857 A 3/1994 Toly
5,697,819 A * 12/1997 Hatagishi ..... 439/752
6,000,967 A * 12/1999 Norizuki et al. ..... 439/596
6,027,374 A * 2/2000 Nagai et al. ..... 439/596
6,319,074 B1 * 11/2001 Kashiyama ..... 439/752

FOREIGN PATENT DOCUMENTS

| | | | |
|---|---|---|---|
| GB | 1 508 114 | 4/1978 | |
| GB | 2 061 637 A | 5/1981 | |
| GB | 2 260 864 A | 4/1993 | |
| JP | 8-138772 | 5/1996 | ..... H01R/9/03 |

* cited by examiner

*Primary Examiner*—Renee Luebke
*Assistant Examiner*—Phong Nguyen
(74) *Attorney, Agent, or Firm*—Sughrue Mion, PLLC

(57) ABSTRACT

A press-connecting connector (1) includes a rear holder (4). The rear holder (4) is pivotally connected to a housing body (2) through hinges (3), and includes slide levers (4B). The slide levers (4B) are engageable in guide spaces (7), formed in the housing body (2) and extending in a forward/rearward direction of the connector (1), and can move in accordance with the pivotal movement of the rear holder (4).

20 Claims, 7 Drawing Sheets

PRESS-CONNECTING CONNECTOR

BACKGROUND OF THE INVENTION

1. Field of the Invention

The present invention relates to a press-connecting connector. More particularly, the present invention relates to an improved rear holder-equipped press-connecting connector in which an open portion,. formed above terminal receiving chambers, is covered with a rear holder, thereby protecting press-connecting terminals, received respectively in the terminal receiving chambers, and also preventing the withdrawal of wires connected respectively to the press-connecting terminals.

The present application is based on Japanese Patent Application No. 2000-199026, which is incorporated herein by reference.

2. Description of the Related Art

In a vehicle (e.g., an automobile etc.), connectors have been extensively used for connecting wire harnesses together and for connecting an electronic equipment to a wire harness. Such connectors have various constructions, and one example of rear holder-equipped press-connecting connectors will be described below with reference to FIGS. 6 and 7.

As shown in FIG. 6, the press-connecting connector 21 comprises a housing body 22, and rear holders 24 which are pivotally connected respectively to upper and lower walls 22C of the housing body 22 through hinges 23 so as to respectively close open portions 27 formed respectively in rear end portions of the upper and lower walls.

A plurality of juxtaposed terminal receiving chambers 25 are formed in the housing body 22, and a press-connecting terminal 31 is received in each of the terminal receiving chambers 25.

The press-connecting terminal 31 includes a press-connecting portion 31A provided generally at a central portion of its elongate body, an electrical connection portion 31B (see FIG. 7) provided forwardly of the press-connecting portion 31A, and a wire clamping portion 31C provided rearwardly of the press-connecting portion 31A.

As shown in FIG. 7, pocket portions 25 for receiving the electrical contact portions 31B are provided at a front portion of the housing body 22 at which the upper and lower walls 22C exist, and retaining grooves 22B are formed respectively in inner surfaces of rear end portions of right and left side walls 22A of the housing body 22.

Each rear holder 24 covers the terminal receiving chambers 25 to protect the press-connecting terminals 31 and also to prevent the withdrawal of wires 32, connected respectively to the press-connecting terminals 31, from the housing body 22. Basically, the rear holder 24 has a plate-like body as shown in FIGS. 6 and 7.

Retaining protuberances 26 are formed on and protect from an inner surface (that is, an upper surface in FIG. 6) of the rear holder 24, and are so arranged as to be disposed in registry with the corresponding terminal receiving chambers 25, respectively. When the rear holder 24 is closed, the retaining protuberances 26 retain the press-connecting terminals 31, received respectively in the terminal receiving chambers 25, respectively, thereby preventing the lifting of the press-connecting terminals 31.

Retaining projections 24A are formed at right and left side ends of the rear holder 24, respectively, and when the rear holder 24 is closed, these retaining projections 24A are engaged respectively in the retaining grooves 22B in the housing body 22 to hold the rear holder 24 in its closed condition.

In the press-connecting connector 21 of the above construction, when the rear holder 24 is pivotally moved through the hinges 23 into its closed position, the retaining projections 24A can be retainingly engaged in the retaining grooves 22B, respectively. In this closed condition, the rear holder 24 itself is prevented from lifting as shown in FIG. 7, and therefore each retaining protuberance 26 is pressed against the upper side of the corresponding wire 32 to prevent it from being withdrawn from the press-connecting terminal 31, and at the same time the retaining protuberance 26 holds the press-connecting terminal 31 in a predetermined position within the terminal receiving chamber 25.

In the above construction, however, the hinges 23 have a band-like shape, and have flexibility, and therefore when closing the rear holder 24, these hinges are deformed, that is, curved and straightened. And besides, when an external force is applied laterally to the rear holder 24, the hinges can be easily flexibly deformed in a direction of the width of the rear holder 24. Accordingly, there is a possibility that the whole of the rear holder 24 is displaced in a direction of the axis of pivotal movement thereof, so that it becomes difficult to close the rear holder in the proper position. Thus, it would invite a possibility that the efficiency of the assembling operation is lowered.

The retaining projections 24A are engaged respectively in the retaining grooves 22B in the housing body 22, thereby maintaining the closed condition of the rear holder in a proper manner. However, when a large impact is applied to the rear side of the rear holder, there is a possibility that the side edges of the hinges 23 are raised beyond the surface of the upper (lower) wall 22C, so that the rear holder is opened.

SUMMARY OF THE INVENTION

The present invention has been made in view of the above possibilities, and an object of the present invention is to provide a press-connecting connector in which when closing a rear holder pivotally connected to a housing body through hinges, an undesirable displacement of the rear holder is prevented, thereby enhancing the efficiency of an assembling operation, and besides the closed condition of the rear holder can be maintained.

To achieve the above object, according to a first aspect of the present invention, there is provided a press-connecting connector which comprises a housing body having an upwardly-open portion, and a plurality of juxtaposed terminal receiving chambers into which a plurality of press-connecting terminals are respectively insertable; a rear holder pivotally connected to the housing body through a hinge, so that the rear holder can close the upwardly-open portion; a guide space formed in the housing body so as to extend in a connector forward/rearward direction; and a slide lever projected on a hinge-connected end portion of the rear holder, wherein when the rear holder is pivotally moved to close the upwardly-open portion, the slide lever is engaged in the guide space so as to prevent displacement of the rear holder in an axial direction of pivotal movement thereof.

In accordance with the first aspect of the present invention, even when an external force is applied laterally (in a right-left direction) to the rear holder, the displacement of the rear holder is prevented by the slide lever engaged in the guide space, thus preventing the lateral displacement in comparison with the related art.

According to a second aspect of the present invention, it is preferable that a distal end portion of the slide lever is slanted in a chamfered manner, so that the slide lever is smoothly introduced and guided into the guide space.

In accordance with the second aspect of the present invention, in an initial condition of the rear holder, the slide lever is not engaged in the guide space, and as the rear holder is pivotally moved, the distal end portion of the slide lever, which is slanting in a chamfered manner, is brought into engagement in the guide space. Therefore, the housing body absorbs a slight lateral displacement of the rear holder so as to achieve the introducing and guiding operation, thereby enhancing the rear holder-attaching ability.

According to a third aspect of the present invention, it is preferable that an engagement surface is formed within the guide space, and the distal end portion of the slide lever is slid on the engagement surface in accordance with the pivotal movement of the rear holder.

In accordance with the third aspect of the present invention, the rear holder is pivotally moved while supported by the hinge (which serves as a pivot member and regulates the rear holder's position) and the distal end portion of the slide lever, and therefore the rear holder is prevented from sinking or intruding into the housing body, so that the pivotal movement can be effected in a stable manner.

According to a fourth aspect of the present invention, the press-connecting connector may further comprise a plurality of retaining projected piece portions formed on the hinge-connected end portion of the rear holder, wherein when the upwardly-open portion is closed with the rear holder, the retaining projected piece portions retainingly engage portions of the housing body that face the upwardly-open portion.

In accordance with the fourth aspect of the present invention, when the rear holder is closed, the retaining projected piece portions retainingly engage the inner surface of the end portion of an upper (lower) wall of the housing body facing the upwardly-open portion. Therefore, even when a large impact force is applied to the rear end of the rear holder, the hinge-connected end portion will not be raised beyond the upper (lower) wall.

Furthermore, to achieve the above object, according to a fifth aspect of the present invention, there is provided a press-connecting connector which comprises a housing body having an upwardly-open portion, and a plurality of juxtaposed terminal receiving chambers into which a plurality of press-connecting terminals are respectively insertable; a rear holder pivotally connected to the housing body through a hinge, so that the rear holder can close the upwardly-open portion; a plurality of guide spaces formed in the housing body so as to extend in a connector forward/rearward direction; and a plurality of slide levers projected on opposite side end portions of the rear holder, wherein when the rear holder is pivotally moved to close the upwardly-open portion, the slide levers are respectively engaged in the guide spaces so as to prevent displacement of the rear holder in an axial direction of pivotal movement thereof.

In accordance with the fifth aspect of the present invention, the slide levers, formed on and projecting respectively from opposite (right and left) side ends of the rear holder, are engaged respectively in the guide spaces during the pivotal movement of the rear holder. Accordingly, even when an external force is applied laterally (in a right-left direction) to the rear holder, the displacement of the rear holder is prevented by the slide levers engaged respectively in the guide spaces, thus preventing the lateral displacement.

Further, according to a sixth aspect of the present invention, it is preferable that distal end portions of the slide levers are respectively slanted in at least a chamfered manner, so that the slide levers are smoothly introduced and guided into the guide spaces.

In accordance with the sixth aspect of the present invention, in an initial condition of the rear holder, the slide levers are not engaged in the guide spaces, and as the rear holder is pivotally moved, the distal end portions of the slide levers, which are slanted in at least a chamfered manner, are brought into engagement in the guide spaces. Therefore, the housing body absorbs a slight lateral displacement of the rear holder so as to achieve the introducing and guiding operation, thereby enhancing the rear holder-attaching ability.

Further, according to a seventh aspect of the present invention, it is preferable that engagement surfaces are respectively formed within the guide spaces, and the distal end portions of the slide levers are respectively slid on the engagement surfaces in accordance with the pivotal movement of the rear holder.

In accordance with the seventh aspect of the present invention, the rear holder is pivotally moved while supported by the hinge (which serves as a pivot member and regulates the rear holder's position) and the distal end portions of the slide levers, and therefore the rear holder is prevented from sinking or intruding into the housing body, so that the pivotal movement can be effected in a stable manner.

According to an eighth aspect of the present invention, the press-connecting connector may further comprise a plurality of retaining projected piece portions respectively formed on hinge-connected end portions of the rear holder, wherein when the upwardly-open portion is closed with the rear holder, the retaining projected piece portions retainingly engage portions of the housing body that face the upwardly-open portion.

In accordance with the eighth aspect of the present invention, when the rear holder is closed, the retaining projected piece portions retainingly engage the inner surface of the end portion of an upper (lower) wall of the housing body facing the upwardly-open portion. Therefore, even when a large impact force is applied to the rear end of the rear holder, the hinge-connected end portion will not be raised beyond the upper (lower) wall.

BRIEF DESCRIPTION OF THE DRAWINGS

The above and other objects and advantages of the present invention will become more apparent by describing in detail a preferred embodiment thereof with reference to the accompanying drawings, wherein.

DETAILED DESCRIPTION OF THE PREFERRED EMBODIMENT

A preferred embodiment of a press-connecting connector of the present invention now will be described in detail with reference to FIGS. 1 to 5.

Figure 1:
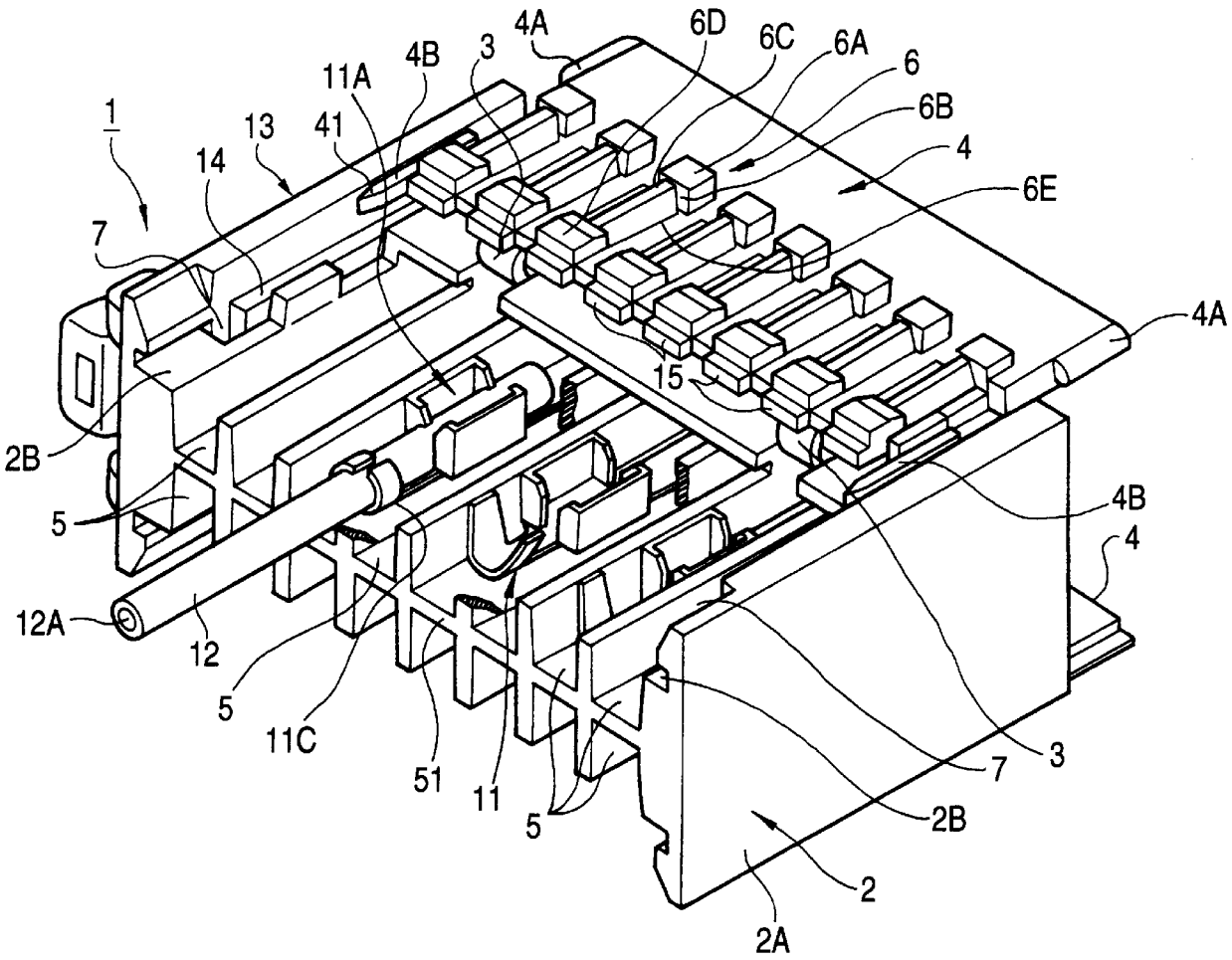
FIG. 1 is a perspective view of one preferred embodiment of a press-connecting connector of the present invention, showing rear holders in their open condition.

As shown in FIG. 1, the press-connecting connector 1 of this embodiment comprises a housing body 2, and rear holders 4 which are pivotally connected respectively to upper and lower walls 2C (only upper one of which is shown in the drawings) of the housing body 2 through hinges 3 so as to respectively close open portions 13 formed in a rear end portion of the housing body 2.

A plurality of juxtaposed terminal receiving chambers 5 are formed in the housing body 2, and a press-connecting terminal 11 is received in each of the terminal receiving chambers 5.

The terminal receiving chambers 5 are arranged in two (upper and lower) rows, and the upper and lower rows of terminal receiving chambers 5 are separated from each other by an intermediate wall 51. The upper and lower portions of the connector are the same in construction, and therefore in infra FIG. 2, description will be made, showing only the upper row of terminal receiving chambers 5.

The press-connecting terminal 11 includes a press-connecting portion 11A provided generally at a central portion of its elongate body, an electrical connection portion 11B (see FIG. 2) provided forwardly of the press-connecting portion 11A, and a wire clamping portion 11C provided rearwardly of the press-connecting portion 11A.

Figure 2:
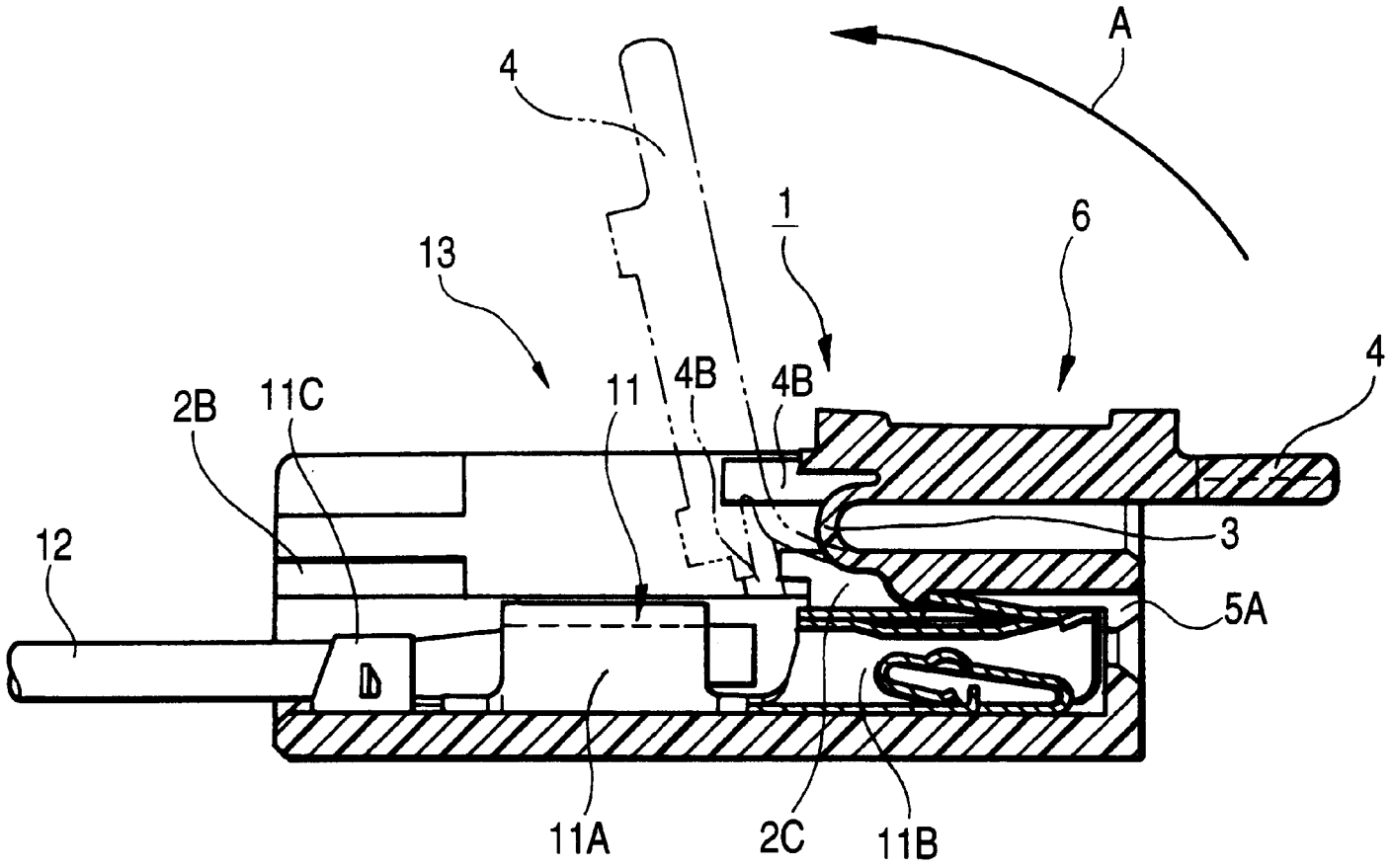
FIG. 2 is a cross-sectional view of the press-connecting connector of FIG. 1.

As shown in FIG. 2, pocket portions 5A for receiving the electrical contact portions 11B are provided at a front portion of the housing body 2 at which the upper and lower walls 2C exist, and retaining grooves 2B are formed respectively in inner surfaces of rear end portions of right and left side walls 2A of the housing body 2.

A guide space 7 is formed between the right side wall 2A of the housing body 2 and its adjoining terminal receiving chamber 5, and also another guide space 7 is formed between the left side wall 2A and its adjoining terminal receiving chamber 5, and these guide spaces 7 extend in a forward/rearward direction of the connector. When the rear holder 4 is pivotally moved, slide levers 4B of the rear holder 4 (more fully described later) are engaged respectively in these guide spaces 7 to prevent the rear holder 4 from being moved in right and left directions upon application of an external force to the rear holder 4, thus preventing the rear holder 4 from being displaced in a direction of the axis of pivotal movement of the rear holder, that is, in a direction of the width of the rear holder.

Figure 4:
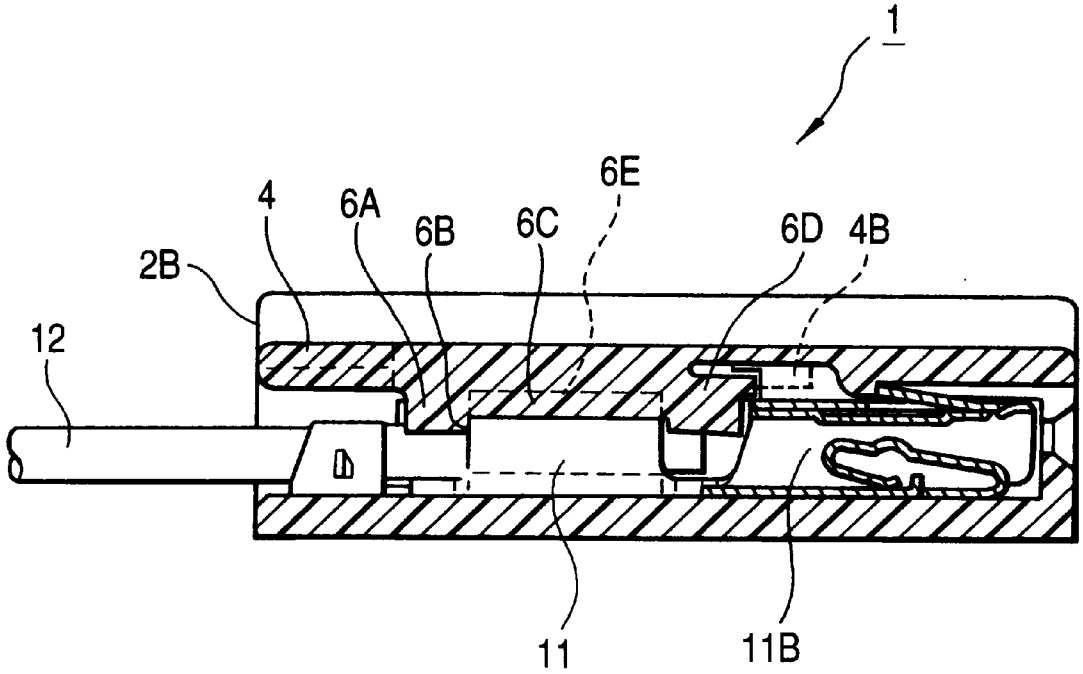
FIG. 4 is a cross-sectional view of the press-connecting connector in a closed condition of a rear holder.
Figure 5:
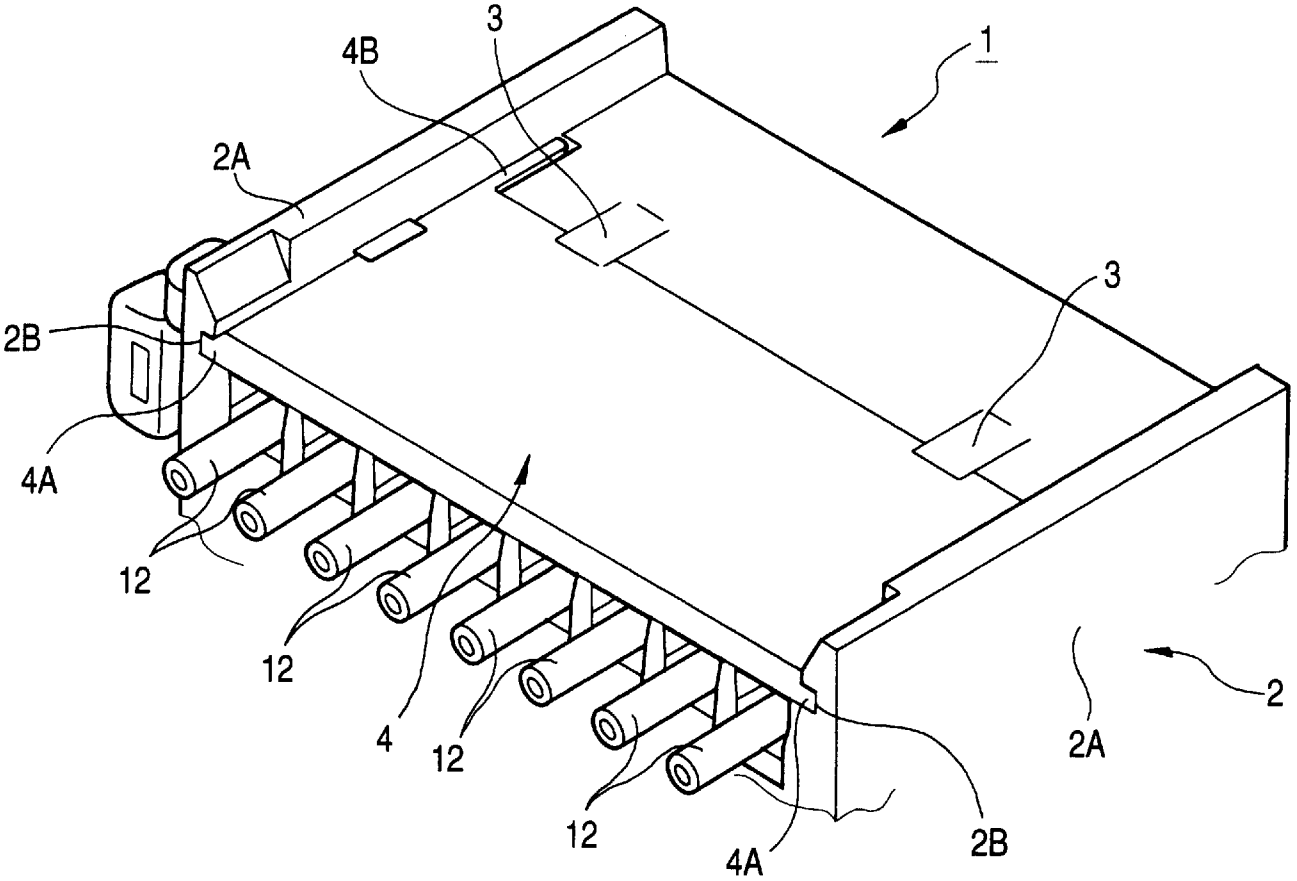
FIG. 5 is a perspective view of the press-connecting connector in the closed condition of the rear holder.
Figure 6:
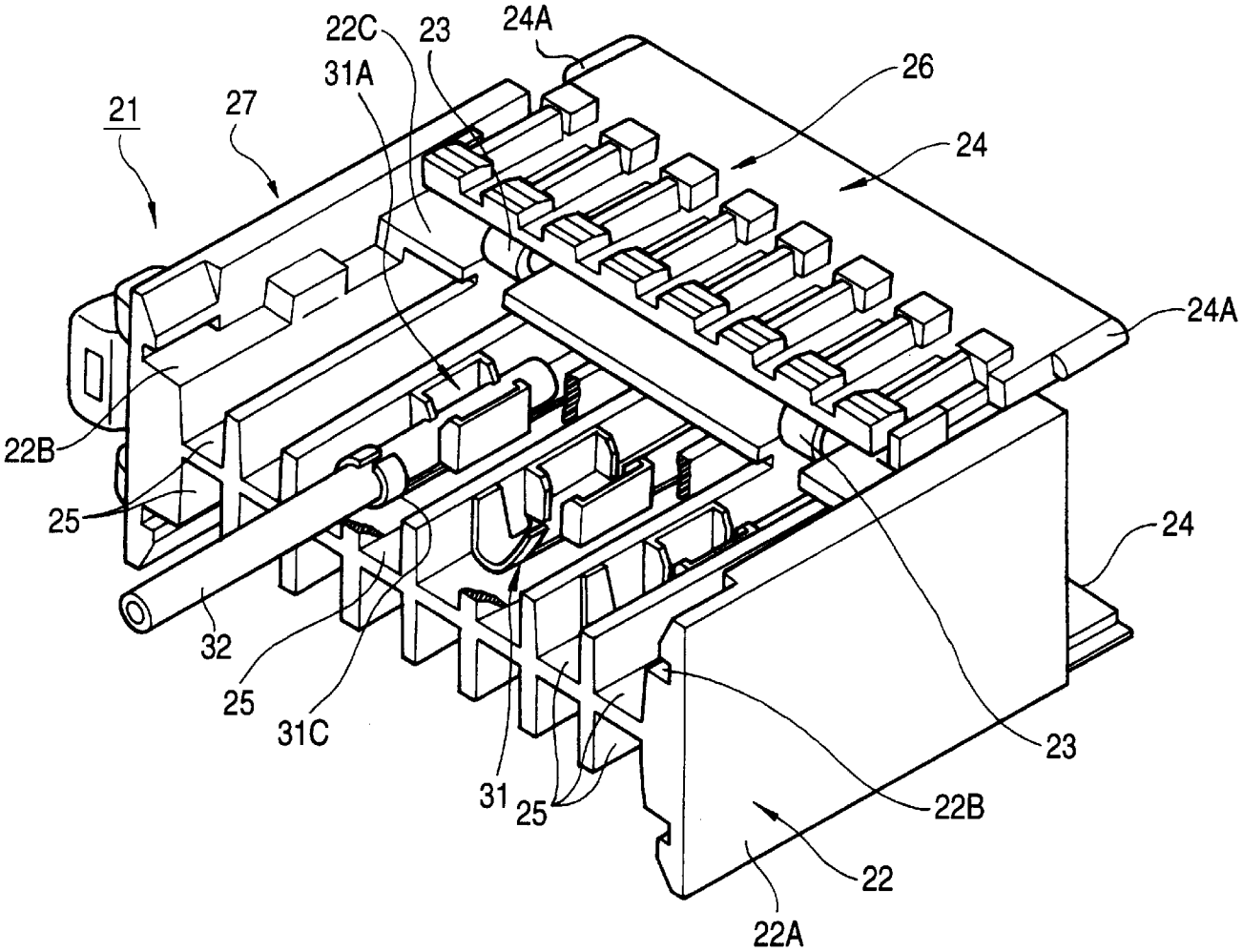
FIG. 6 is a perspective view of a related press-connecting connector.
Figure 7:
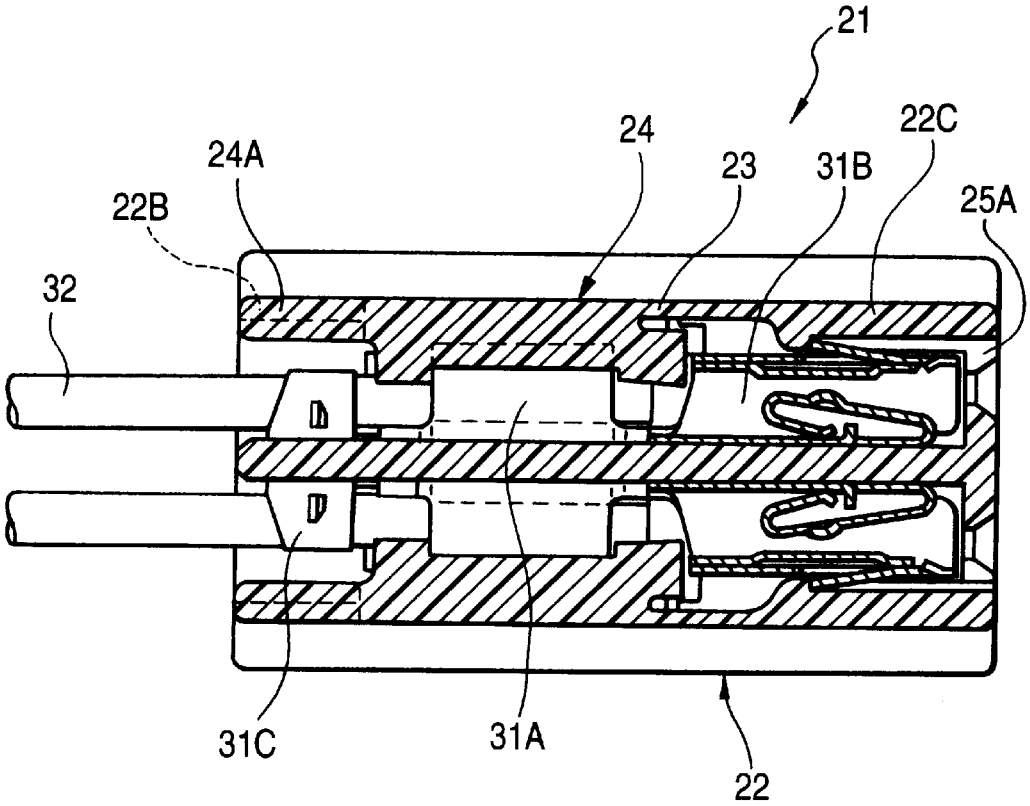
FIG. 7 is a cross-sectional view of the related press-connecting connector.

The rear holder 4 closes the upwardly-open portion 13 to protect the press-connecting terminals 11 and wires 12 connected respectively to the press-connecting terminals 11. Basically, the rear holder 4 has a plate-like body as shown in FIGS. 2 and 4.

Retaining projections 4A are formed respectively at opposite (right and left) side ends of the rear holder 4 at a free end portion thereof, and when the rear holder 4 is closed, these retaining projections 4A are engaged respectively in the retaining grooves 2B in the housing body 2 to hold the rear holder 4 in its closed condition.

The slide levers 4B are formed respectively at the opposite (right and left) side ends of the rear holder 4 at the other end portion thereof (that is, hinge-connected end portion), and these slide levers 4B project beyond the hinge-connected end portion. As the rear holder 4 is pivotally moved, the slide levers 4B are gradually inserted respectively into the guide spaces 7 in the housing body 2, and move in these guide spaces 7, respectively.

The guide spaces 7 will be described more specifically. Each guide space 7 is formed through the relevant portion of the housing body, and extends toward the lower terminal receiving chamber, and an engagement surface 14, defined by a step portion, is formed within the guide space 7, and a distal end 41 of the slide lever 4B slides over this engagement surface 14 during the pivotal movement of the rear holder 4. Because of the provision of these engagement surfaces 14, the rear holder pivotally moves while supported by the hinges and the distal ends of the slide levers, and therefore the rear holder is prevented from accidentally intruding into the housing body, so that the rear holder can be pivotally moved in a stable manner.

Figure 3:
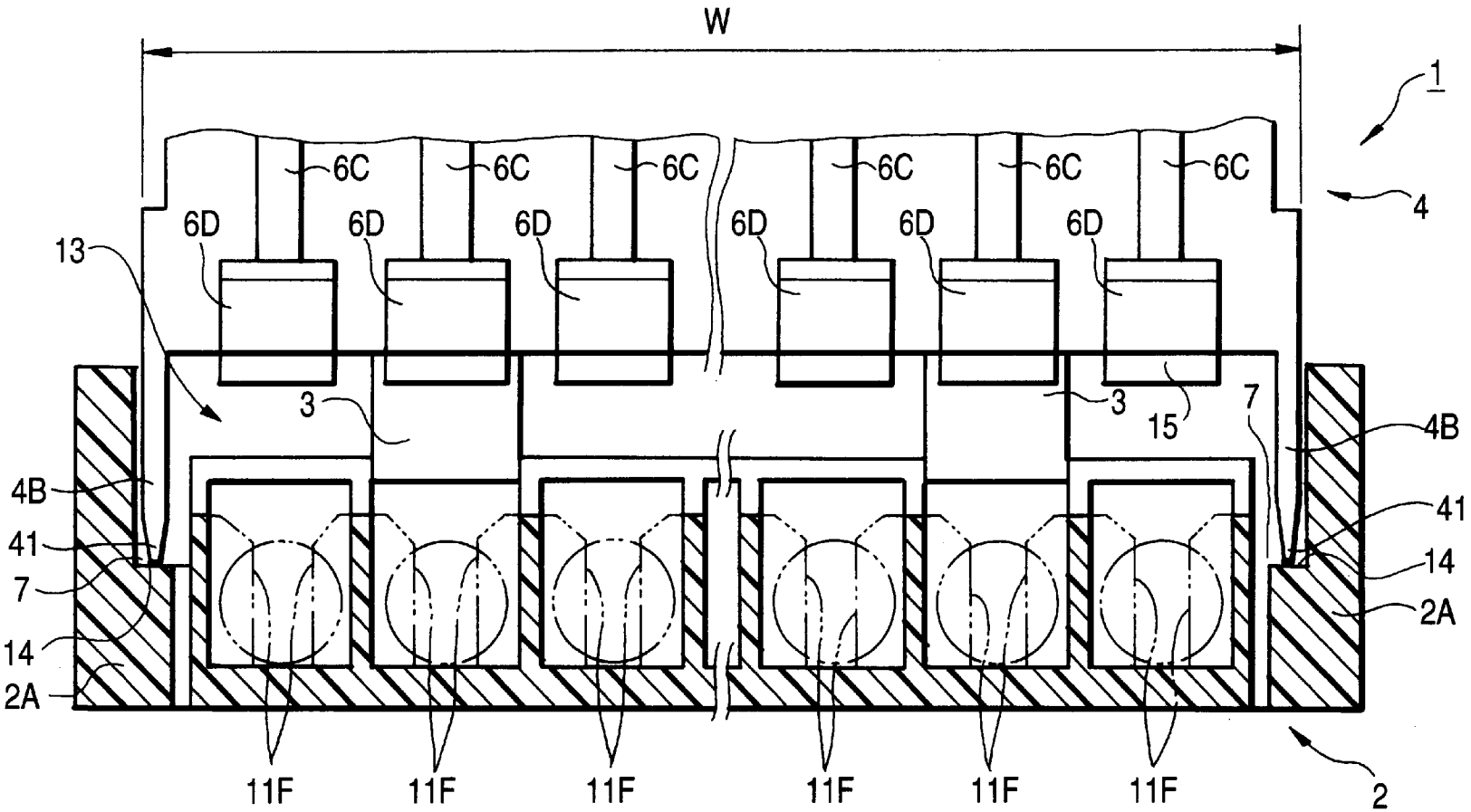
FIG. 3 is an enlarged, cross-sectional view of a portion of the press-connecting connector, showing a rear holder-closing operation.

As schematically shown in FIG. 3, the distance W between the outer surfaces of the two slide levers 4B is so determined that the slide levers 4B can be substantially disposed in contact with side wall surfaces of the guide spaces 7, respectively. Therefore, even when an external force is applied laterally to the rear holder 4, these slide levers prevent the flexible deformation of the hinges 3, thereby preventing the displacement of the rear holder 4 in the direction of the width thereof. As shown in FIG. 3, the distal end portion 41 of the slide lever 4B is slanting in a chamfered, tapering manner, and therefore even when the rear holder 4 is displaced laterally (in the direction of the axis of pivotal movement thereof) immediately before each slide lever 4B is inserted into the guide space 7, the slide lever 4B can be easily introduced and guided into the guide space 7.

Retaining projected piece portions 15 are formed at the hinge-connected end portion of the rear holder 4, and when the rear holder 4 is closed, these portions 15 engage the inner surface of the end portion of the upper (lower) wall 2C facing the upwardly-open portion 13. The retaining projected piece portions 15 are so arranged as to be disposed in registry with the terminal receiving chambers 5, respectively, and when the rear holder 4 is pivotally moved into its closed position, each of these portions 15 will not interfere with partition walls each separating the adjacent terminal receiving chambers from each other. Because of the provision of these retaining projected piece portions 15, the rear holder 4, when disposed in its closed position, is fixed by the double locking, that is, the locking by the retaining projections 4A and the retaining grooves 2B, disposed at the rear portion of the connector, and the locking by the retaining projected piece portions 15 and the upper (lower) wall 2C disposed at the front portion of the connector. Particularly because of the formation of the retaining projected piece portions 15, the lifting of the rear holder 4 relative to the upper (lower) wall 2C is prevented, and therefore the rear holder 4 is firmly held in its closed condition.

Retaining protuberances 6 are formed on and project from the inner surface (that is, the upper surface in FIG. 1) of the rear holder 4.

The retaining protuberances 6 are so arranged as to be disposed in registry with the terminal receiving chambers 5, respectively. Each retaining protuberance 6 includes a first projection 6A, a second projection 6C extending from a rear surface 6B of the first projection 6A, and a third projection 6D extending from the second projection 6C. As shown in FIG. 4, those portions of the inner surface of the rear holder, disposed adjacent respectively to opposite side surfaces of the second projection 6C, serve as press-contact surfaces 6E for pressing the press-connecting terminal 11 from the upper side.

The first projection 6A, the second projection 6C and the third projection 6D will be described in further detail. The first projection 6A has a generally rectangular parallelepiped shape, and has the rear surface 6B from which the second projection 6C extends. When the rear holder 4 is pivotally moved through the hinges 3 from its open position to its closed position to close the upwardly-open portion 13 in the housing body 2, the rear surface 6B engages the rear end of the press-connecting portion 11A of the press-connecting terminal 11 to hold this terminal 11 in the predetermined position.

The second projection 6C is in the form of an elongate projection, and extends in the direction of the length of the press-connecting terminal 11. When the rear holder 4 is closed, an upper surface of the second projection 6C is pressed against that portion of the wire 12 laid on the press-connecting portion 11A. The third projection 6D has a generally rectangular parallelepiped shape, and when the rear holder 4 is closed, an upper surface of the third projection 6D engages that portion of the wire 12 disposed forwardly of the press-connecting portion 11A.

Next, an assembling operation of the press-connecting connector 1 will be described.

For effecting the assembling operation of the press-connecting connector 1, each rear holder 4 is kept in the open condition, and then the press-connecting terminals 11 are received in the terminal receiving chambers 5, respectively, and then the wire 12 is laid on the press-connecting portion 11A of each terminal, and is press-fitted into the press-connecting portion 11A by a press-connecting jig (not shown) As a result, press-connecting blades 11F (see FIG. 3) cut a sheath of the wire, and a conductor 12A of the wire is brought into contact with the press-connecting portion 11A, so that an electrical connection between the press-connecting terminal 11 and the wire 12 is made. Then, the wire clamping portion 11C is press-deformed to hold the wire 12.

The press-fitting of the wires 12 do not always need to be effected by the press-connecting jig, and in this case the connector can be so constructed that the press-fitting of the wires 12 can be effected by the second projections 6C when the rear holder 4 is closed.

After the connection of the wires 12 to the respective terminals by the press-connecting jig is finished, the rear holder 4 is pivotally moved through the hinges 3 to close the upwardly-open portion 13. In this embodiment, at this time, the following operation, which is to be noted, is effected.

Namely, when the rear holder 4 is in the completely-open condition as shown in FIG. 1, each slide lever 4B is completely spaced apart from the corresponding guide space 7 as shown in FIGS. 1 and 2. In this condition, when the rear holder 4 is pivotally moved through the hinges 3 in a direction of arrow A (FIG. 2), the distal end 41 of the slide lever 4B, so far spaced apart from the guide space 7, enters this guide space 7. In this condition, when the rear holder is further pivotally moved in the direction of arrow A, the distal end 41 of the slide lever 4B is brought into contact with the engagement surface 14 within the guide space 7, and slides over this engagement surface 14 in accordance with the pivotal movement of the rear holder 4.

Each hinge 3 has a band-like shape, and is flexible though not stretchable. Therefore, as already described, during the pivotal movement of the rear holder 4, the hinge 3 is not kept in a curved condition, but is partially deformed, that is, curved and straightened, in accordance with-the closing angle, and besides the hinge can be easily flexibly deformed in the direction of the width of the rear holder 4. Also, there are occasions when one of the opposite side portions of the rear holder, spaced from each other in the direction of the width thereof, goes ahead or behind relative to the other, so that the rear holder is being closed in an oblique condition.

In this embodiment, however, the rear holder 4 is pivotally moved while the slide levers 4B, formed respectively at the opposite (right and left) side ends of the rear holder 4, are engaged in the guide spaces 7, respectively, and therefore even when an external force is applied laterally to the rear holder 4, the movement of the rear holder 4 in the right and left directions is prevented, so that the whole of the rear holder 4 is prevented from being displaced in the direction of the width thereof.

And besides, the distal end portion 41 of the slide lever 4B is tapering, and therefore the slide lever 4B can be introduced and guided into the guide space 7 without being caught by the edge of this guide space 7.

Even when the hinges 3 are deformed into a straight shape during the pivotal movement of the rear holder 4, the rear holder 4 is prevented from lifting and sinking since the pivotal movement is effected, with the distal end 41 of each slide lever 4B held in contact with the engagement surface 14 in the guide space 7, that is, the pivotal movement is effected through the correlated operation of the hinges 3 and the engagement surfaces 14, and therefore the rear holder is pivotally moved into its closed position without being brought out of registry with the upwardly-open portion 13, and is joined to the housing body 2.

When the rear holder 4 is thus closed, the retaining projections 4A are brought into engagement in the retaining grooves 2B, respectively, and also the retaining projected piece portions 15 slip under the end portion of the upper (lower) wall 2C, facing the upwardly-open portion 13, and engage the inner surface of this end portion, so that the rear holder is locked at the front and rear portions of the connector in a double manner. Therefore, even when a large impact force is applied to the rear end of the rear holder 4 in the closed condition, the rear holder 4 will not be raised beyond the upper (lower) wall 2C at its hinge-connected end portion (to which the hinges 3 are connected), and therefore will not be opened.

When the rear holder 4 closes the upwardly-open portion 13 in the housing body 2, the first projection 6A of each retaining protuberance 6 is pressed against the wire 12 to hold the same, and its rear surface 6B abuts against the rear end of the press-connecting terminal 11, as shown in FIG. 4. As a result, the press-connecting terminal 11 is held in position, and at the same time the withdrawal of the wire 12 is positively prevented.

The second projection 6C of the retaining protuberance 6 presses that portion of the wire 12, press-fitted in the press-connecting portion 11A, downwardly. As a result, the lifting of the wire 12 is prevented, thereby positively preventing the incomplete connection.

The press-contact surfaces 6E, disposed adjacent to the retaining protuberance 6, are held against opposed side walls of the press-connecting portion 11A to press this press-connecting portion 11A downwardly. As a result, the press-connecting portion 11A is held between a bottom surface of the terminal receiving chamber 5 and the press-contact surfaces 6E, thereby positively preventing the lifting of the press-connecting terminal 11.

As described above, in the press-connecting connector 1 of this embodiment, the displacement of the rear holder 4 during the closing movement thereof is prevented through the correlated operation of the slide levers 4B, formed on the rear holder 4, and the guide spaces 7 formed in the housing body 2. After the rear holder 4 is closed, the withdrawal and lifting of the press-connecting terminals 11 and the wires 12 are positively prevented by the retaining protuberances 6 formed on the rear holder 4.

In the above embodiment, although the pair of slide levers are provided respectively at the opposite (right and left) side ends of the rear holder, the position-regulating mechanism may be provided by one slide lever and one guide space for the purpose of preventing the displacement of the rear holder in the direction of the axis of pivotal movement thereof.

As described above, the rear holder, while engaged in the guide spaces in the housing body, is pivotally moved. Therefore, even when an external force is applied laterally to the rear holder, the rear holder can be pivotally moved while preventing the lateral displacement by the position-regulating effect achieved by the slide levers and the guide spaces. Namely, when the rear holder is pivotally moved through the hinges, the rear holder can be smoothly mounted in the predetermined position without displacement to close the upwardly-open portion in the housing body because of the above position-regulating operation, and the efficiency of the assembling operation can be improved.

The distal end portion of each slide lever is slanting in a chamfered manner, and therefore can be introduced and guided into the guide space while absorbing the displacement of the rear holder, so that the rear holder-attaching ability of the housing body can be enhanced.

The rear holder is supported by the correlated operation of the hinges and the slide levers, and therefore the rear holder can be pivotally moved in a stable manner.

The rear holder, when disposed in the closed condition, is locked to the housing body in a double manner, and therefore the reliability of the connector is enhanced.

It is contemplated that numerous modifications may be made to the press-connecting connector of the present invention without departing from the spirit and scope of the invention as defined in the following claims.

What is claimed is:

1. A press-connecting connector, comprising:

a housing body having an upwardly-open portion, and plurality of juxtaposed terminal receiving chambers into which a plurality of press-connecting terminals are respectively insertable;

a rear holder including a distal end portion and a hinge-connected end portion, said hinge-connected end portion being pivotally connected to the housing body through a hinge, so that the rear holder can close the upwardly-open portion;

a guide space formed in the housing body so as to extend in a connector forward/rearward direction; and a slide lever projected from the hinge-connected end portion of the rear holder, wherein when the rear holder is pivotally moved to close the upwardly-open portion, the slide lever is engaged in the guide space so as to prevent displacement of the rear holder in an axial direction of pivotal movement thereof.

2. The press-connecting connector of claim 1, wherein an engagement surface is formed within the guide space, and a distal end portion of the slide lever is slid on the engagement surface in accordance with the pivotal movement of the rear holder.

3. The press-connecting connector of claim 1, wherein the slide lever projects in a direction opposite the distal end portion of the rear holder.

4. The press-connecting connector of claim 2, further comprising a plurality of retaining projected piece portions formed on the hinge-connected end portion of the rear holder, wherein when the upwardly-open portion is closed with the rear holder, the retaining projected piece portions retainingly engage portions of the housing body that face the upwardly-open portion.

5. The press-connecting connector of claim 1, wherein a distal end portion of the slide lever is slanted in a chamferedmanner, so that the slide lever is smoothly introduced and guided into the guide space.

6. The press-connecting connector of claim 5, further comprising a plurality of retaining projected piece portions formed on the hinge-connected end portion of the rear holder, wherein when the upwardly-open portion is closed with the rear holder, the retaining projected piece portions retainingly engage portions of the housing body that face the upwardly-open portion.

7. The press-connecting connector of claim 5, wherein an engagement surface is formed within the guide space, and the distal end portion of the slide lever is slid on the engagement surface in accordance with the pivotal movement of the rear holder.

8. The press-connecting connector of claim 7, further comprising a plurality of retaining projected piece portions formed on the hinge-connected end portion of the rear holder, wherein when the upwardly-open portion is closed with the rear holder, the retaining projected piece portions retainingly engage portions of the housing body that face the upwardly-open portion.

9. A press-connecting connector, comprising:

a housing body having an upwardly-open portion, and a plurality of juxtaposed terminal receiving chambers into which a plurality of press-connecting terminals are respectively insertable;

a rear holder including a distal end portion and a hinge-connected end portion, said hinge-connected end portion being pivotally connected to the housing body through a hinge, so that the rear holder can close the upwardly-open portion;

a guide space formed in the housing body so as to extend in a connector forward/rearward direction;

a slide lever projected from the hinge-connected end portion of the rear holder, wherein when the rear holder is pivotally moved to close the upwardly-open portion, the slide lever is engaged in the guide space so as to prevent displacement of the rear holder in an axial direction of pivotal movement thereof; and a plurality of retaining projected piece portions formed on the hinge-connected end portion of the rear holder, wherein when the upwardly-open portion is closed with the rear holder, the retaining projected piece portions retainingly engage portions of the housing body that face the upwardly-open portion.

10. The press-connecting connector of claim 9, wherein the slide lever projects in a direction opposite the distal end portion of the rear holder.

11. A press-connected connector, comprising:

a housing body having an upwardly-open portion, and a plurality of juxtaposed terminal receiving chambers into which a plurality of juxtaposed terminal receiving chambers into which a plurality of press-connecting terminals are respectively insertable;

a rear holder including a distal end portion and a hinge-connected end portion, said hinge-connected end portion being pivotally connected to the housing body through a hinge, so that the rear holder can close the upwardly-open portion;

a plurality of guide spaces formed in the housing body so as to extend in a connector forward/rearward direction; and a plurality of slide levers projected from the hinge-connected end portion of the rear holder at opposite side end portions thereof, wherein when the rear holder is pivotally moved to close the upwardly-open portion, the slide levers are respectively engaged in the guide spaces so as to prevent displacement of the rear holder in an axial direction of pivotal movement thereof.

12. The press-connecting connector of claim 11, wherein the slide levers project in a direction opposite the distal end portion of the rear holder.

13. The press-connecting connector of claim 11, wherein engagement surfaces are respectively formed within the guide spaces, and distal end portions of the slide levers are respectively slid on the engagement surfaces in accordance with the pivotal movement of the rear holder.

14. The press-connecting connector of claim 13, further comprising a plurality of retaining projected piece portions respectively formed on hinge-connected end portions of the rear holder, wherein when the upwardly-open portion is closed with the rear holder, the retaining projected piece portions retainingly engage portions of the housing body that face the upwardly-open portion.

15. The press-connecting connector of claim 11, wherein distal end portions of the slide levers are respectively slanted in at least a chamfered manner, so that the slide levers are smoothly introduced and guided into the guide spaces.

16. The press-connecting connector of claim 15, further comprising a plurality of retaining projected piece portions respectively formed on hinge-connected end portions of the rear holder, wherein when the upwardly-open portion is closed with the rear holder, the retaining projected piece portions retainingly engage portions of the housing body that face the upwardly-open portion.

17. The press-connecting connector of claim 15, wherein engagement surfaces are respectively formed within the guide spaces, and the distal end portions of the slide levers are respectively slid on the engagement surfaces in accordance with the pivotal movement of the rear holder.

18. The press-connecting connector of claim 17, further comprising a plurality of retaining projected piece portions respectively formed on hinge-connected end portions of the rear holder, wherein when the upwardly-open portion is closed with the rear holder, the retaining projected piece portions retainingly engage portions of the housing body that face the upwardly-open portion.

19. A press-connecting connector, comprising:

a housing body having an upwardly-open portion and a plurality of juxtaposed terminal receiving chambers into which a plurality of press-connecting terminals are respectively insertable;

a rear holder including a distal end portion and a hinge-connected end portion, said hinge-connected end portion being pivotally connected to the housing body through a hinge, so that the rear holder can close the upwardly-open portion;

a plurality of guide spaces formed in the housing body so as to extend in a connector forward/rearward direction;

a plurality of slide levers projected from the hinge-connected end portion of the rear holder at opposite side end portions thereof, wherein when the rear holder is pivotally moved to close the upwardly-open portion, the slide levers are respectively engaged in the guide spaces so as to prevent displacement of the rear holder in an axial direction of pivotal movement thereof; and a plurality of retaining projected piece portions respectively formed on hinge-connected end portions of the rear holder, wherein when the upwardly-open portion is closed with the rear holder, the retaining projected piece portions retainingly engage portions of the housing body that face the upwardly-open portion.

20. The press-connecting connector of claim 19, wherein the slide levers project in a direction opposite the distal end portion of the rear holder.

* * * * *